United States Patent [19]

Neubauer et al.

[11] 4,340,406

[45] Jul. 20, 1982

[54] PRESSURIZED GAS ACCELERATORS FOR RECIPROCATING DEVICE

[75] Inventors: Jeffrey A. Neubauer, Boiling Springs, N.C.; Walter J. Reese, North Huntington, Pa.

[73] Assignee: PPG Industries, Inc., Pittsburgh, Pa.

[21] Appl. No.: 221,489

[22] Filed: Dec. 30, 1980

[51] Int. Cl.[3] ..... C03B 37/025

[52] U.S. Cl. ..... 65/9; 65/10.1; 65/11.1; 193/35 A

[58] Field of Search ..... 193/35 A; 65/10.1, 11.1, 65/9, 4.4

[56] References Cited

U.S. PATENT DOCUMENTS

| | | | |
|---|---|---|---|
| 3,756,893 | 9/1973 | Smith | 156/440 |
| 3,844,191 | 10/1974 | Sears et al. | 83/420 |
| 3,850,723 | 11/1974 | Ackley | 156/180 |
| 3,883,333 | 5/1975 | Ackley | 65/2 |
| 3,915,681 | 10/1975 | Ackley | 65/9 |
| 4,046,538 | 9/1977 | Thomas | 65/4 |
| 4,052,182 | 10/1977 | Stalego et al. | 65/3 |

OTHER PUBLICATIONS

Research Disclosure S03580059 #189, Jan. 1980, p. 38, Disclosed anonymously 18934.

*Primary Examiner*—Robert L. Lindsay, Jr.

*Attorney, Agent, or Firm*—Kenneth J. Stachel

[57] ABSTRACT

A reciprocating traversing apparatus discharges material onto, inspects marks, or cleans a device that it is traversing is provided that has reduced requirements for a driving motor, and has smoother traversing motion. A traversing mechanism has a driving motor with horsepower and torque requirements to maintain operational speed of the reversible traversing mechanism. The driving force to overcome inertia of the traversing mechanism when it reverses to traverse in the opposite direction is provided by a gas cylinder with extending arm. The traversing mechanism moving in a track has a gas cylinder at each end of the track. The extended arm of the cylinder engages the mechanism as it approaches one end of its traverse. The arm is depressed, and when the motor reverses the arm is extended by gas pressure to its original position. By the extension the arm accelerates the mechanism up to is operational speed. The motor continues to drive the mechanism to the other end of the traverse, where the mechanism engages the extended arm of the other gas cylinder.

17 Claims, 3 Drawing Figures

PRESSURIZED GAS ACCELERATORS FOR RECIPROCATING DEVICE

This invention relates to reciprocating devices and more particularly to reciprocating feeding devices for feeding glass fiber into a mat, where the feeder is provided with means for accelerating upon reversal of the direction of travel at the end of each traversing stroke.

Glass fibers and glass fiber strands have been used in the art to produce various types of glass fiber mats. Chopped glass fiber strands can be placed on a moving conveyor to form a type of mat which is then used to reinforce polymeric materials. In addition, continuous glass fiber strands have been used in a variety of ways to produce mats useful for a plurality of purposes. A particular utility is the use of continuous glass fiber strand mat as reinforcement for resinous material. The resinous materials are usually impregnated into the glass fiber mat to act as the matrix. The presence of the glass fiber mat provides increased strength over that of the normal polymeric material. If a non-uniform mat is used for such reinforcement purposes, the reinforced products produced therefrom will have substantial variation in strength, and some areas will be weaker due to a lack of glass fiber reinforcement and other areas will be stronger due to an increased amount of glass fiber in the matrix.

A particularly useful glass fiber mat that has been used in the art is a mat that is formed on a conveyor and subsequently needled in order to provide mechanical strength to the continuous strand mat. A high strength, needled, continuous glass fiber strand mat has been produced by laying down continuous glass strands on a moving conveyor from a plurality of feeders, which are traversed across the width of the conveyor. The mat, after its formation on a conveyor, is passed through a needler to impart the mechanical integrity to the mat by puncturing the glass strand mat with a multiplicity of rapidly reciprocating barbed needles.

In producing mats from continuous glass fiber strands, it is also known that the feeder traversing the conveyor at an angle, which is perpendicular to the path of the conveyor, can act as an attenuator to attenuate the glass fibers from a glass fiber producing furnace. Also, the feeder can supply continuous glass fiber strands from packages of glass fiber strands produced in a separate operation to that of forming the glass fibers from the glass fiber furnace. In either approach the constant motion of the feeder or attenuator and the reciprocation thereof places a great deal of stress on the traversing mechanism which causes vibration and may cause subsequent failure of the mechanical components of the traversing system.

An example of a traversing mechanism is a feeder device or attenuator that is mounted on a track where the traversing feeder moves along the track by means of an electric motor capable of reversing directions. A failure in such a mechanism would cause an interruption of the mat forming process and losses in production time due to repairs. In addition, a minor failure would cause the production of a non-uniform glass fiber mat.

A substantial amount of the strain on the mechanical parts of the traversing system and the feeder or attenuator itself can be caused by the acceleration and deceleration forces associated with the reversal of the feeder. Further, because of the abrupt motion or jerking or vibration of the feeder or attenuator and the pauses during the reversal it has been found that the glass fibers tend to accumulate at the terminal point of the reciprocating stroke of the feeder thus forming a mat of substantially non-uniform density. Such pauses could occur when the horsepower of the motor driving the feeder or attenuator is just adequate to provide the operational speed of the feeder or attenuator. In this case right after reversal the feeder or attenuator must be accelerated to operational speed. During this acceleration, a small horsepower motor might stall. Stalling would cause a buildup of strands at that point, and such a buildup leads to the formation of nonuniform mat.

U.S. Pat. No. 3,915,681 provided an apparatus for reducing the vibration normally associated with the reversal of direction of a reciprocating mass like an attenuator. This was accomplished by having a traversing mechanism that had a continuous traveling track such as a chain having affixed thereto an extended member or pin which engaged a slot in the carriage of the movable device to be traversed. The extended member or pin was placed an equal distance from the juxtaposed portions of the traveling track. The extended member, while exerting a force on the attenuator carriage, is at a periphery of the slot. The slot is positioned so that its length is parallel to the direction of the travel of the traveling track and has a length substantially greater than the pin size. Thus, when the carriage is traveling in one direction, the pin will be at the periphery of the slot on one end thereof and when the carriage is traveling in the opposite direction, the pin will be in contact with the periphery of the slot at the opposite end thereof. Then when the carriage supporting the movable device approaches the termination point of a stroke during the traversing cycle, the movable device contacts a shock absorbing member which decelerates the movable device at a uniform rate of deceleration. Also, the shock absorbing members can be completely elastic in order that all the accelerating and decelerating forces are provided therefrom. When completely elastic shock absorbing members are used, the slot length should be twice the length of travel of the shock absorbing member plus that portion of the length occupied by the pin.

Such an apparatus was successful in reducing vibration in the traversing feeder system, but the pin and slot arrangement still involved the use of additional mechanism that could possibly be prone to interruption of operation due to mechanical failure. In addition with the use of this arrangement for providing additional acceleration to the traversing feeder, the motor providing the prime motive force had to supply some of the acceleration. It would be desirable to use a motor rated to provide just enough power to move the feeder or attenuator in the traversing motion without the requisite power to accelerate the feeder and, thereby, have a more efficient apparatus for bringing the feeder or attenuator up to operational speed from the reversal of direction at the end of the traversing stroke.

It is an object of the present invention to provide an apparatus for supplying the acceleration to a reciprocating feeder or attenuator when the feeder or attenuator reaches the end of the traversing stroke and reverses direction.

It is an additional object of the present invention to have an apparatus that provides the accelerating force needed for the reciprocating feeder or attenuator when the device reverses direction and also that provides a decelerating effect when the reciprocating feeder reaches the end of its traversing stroke before reversing direction.

SUMMARY OF THE INVENTION

An apparatus is provided for reducing the vibration normally associated with the reversal of direction of a powered reciprocating mass, where the power requirements are more efficiently met. The efficiency in meeting the power requirements allows the use of a smaller horsepower motor to drive the reciprocating mass. The motor to drive the reciprocating mass does not need the horsepower and torque output to overcome the inertia of the reciprocating mass, when the reciprocating mass reverses directions.

This is accomplished by having a traversing mechanism that has a continuous traveling track such as a chain having afixed thereto an attachment means to the carriage of the movable device to be traversed. At the end of each stroke of the traversing device, the traversing device contacts an extended member from a gas cylinder. When the carriage supporting the traversing device approaches the termination point of a stroke during the traversing cycle, the traversing device contacts the extended member of the gas cylinder and depresses the extended member into the gas cylinder. The displaced gas from the cylinder flows out of the cylinder. The compressed extending member can be extended by the flow of gas into the cylinder. The gas can be supplied from a separate or a common gas source or a captive gas system. The captive gas system captures the displaced gas from compression of the extending member by conduits attached to the gas cylinder and has a pressure sufficient to accelerate the traversing device to the operating traversing speed. When the power source for the traversing device reverses direction, the depressed member in the gas cylinder is extended to its fully extended position to accelerate the traversing device to near its operating speed and the power device continues to propel the traversing device to the other termination point of its stroke, where it contacts another extended member of another gas cylinder.

The reciprocating traversing device may comprise a glass fiber attenuator or feeder, hereinafter in the specification and claims both are referred to as feeders, a spraying device or a device for discharging powders or vapors, or it may comprise a cutting, scoring or severing device such as for cutting a continuous sheet, e.g. glass, paper, fabric or the like, or it may comprise an inspecting device such as a camera or an electrooptical device for detecting flaws in sheet materials, or it may comprise a marking device such as a printing roll or it may comprise cleaning devices such as brushes or the like.

The gas cylinder used at the opposite ends of the traversing stroke have extended members that can have any shape similar to that of a piston rod that moves in and out of the cylinder as the piston to which it is attached moves from near one end in the cylinder to the other end. The gas within the cylinder can be any gas such as air and the like. The cylinder at any point, other than the point where the extended member enters the cylinder, can have a port for the ingress or egress of the gas to extend the extending member or to relieve the gas pressure when the extending member is compressed by the reciprocating traversing device.

A port in the cylinder is connected to a gas supply or to a surge area for supplying gas pressure to extend the extending member or plunger. The surge area can be a larger conduit than the conduit connecting the surge area to a cylinder or it can be a conventional tank. From the surge area there is a supply line to supply gas to the system that includes the surge area, conduit connecting the surge area with the cylinder, and cylinder. The supply line has a regulator so as to maintain a captive pressure within the gas system. In the absence of a captive gas system the supply line is connected to the cylinder port to supply blasts of gas to each cylinder to extend the piston rod. The pressure is sufficient to move the mass of the reciprocating traversing device to at or near its operating speed for the reciprocating traversing device. A nonexclusive example is an air pressure, of around 20 psig to move a reciprocating traversing device having a mass of around 35 kg. to a speed of around 2 to around 3 ft/sec. If the mass of the reciprocating traversing device is larger than this specified mass, the air pressure would have to be higher in order to obtain the same or a faster speed. Of course, if the mass is lighter, the air pressure can be lower to obtain the same speed and possibly higher speeds and lower speeds. The reciprocating traversing device can be powered by any conventional motor adapted to drive the feeder in one direction and to reverse in order to drive the feeder in the other direction. The motor for driving the feeder in a forward and reverse direction can be in a circuit with means for energizing and controlling the operating of the motor through a sensing means responsive to the location of the traversing feeder before it reaches the end of a stroke.

DESCRIPTION OF THE DRAWINGS

In FIG. 1 there is shown a traversing mechanism of the invention, which is depositing glass fibers on a conveyor. Mounting members 1 and 2 support the traversing mechanism above the belt conveyor 3 on which the glass fiber strand 4 is deposited. The glass fiber strand 4 is being pulled from a supply of glass fiber strands, not shown in the drawings, to the traversing feeder, number 14. The strands, 4, are deposited on the belt 5 on conveyor 3 perpendicular to the path of travel of the belt 5 on the conveyor 3. The glass fiber strand 4 so deposited, forms a mat, 6, which may be used for the reinforcement of resinous material. The belt 5 is supported by the roll 7 which is driven by the shaft 8. The shaft is driven by a motor (not shown) which provides constant uniform motion of the conveyor 3. In feeder 14 the rollers and belt to convey the glass fiber strand are shown, but the motor which may be attached to the feeder to supply the power to move the rollers and belts is not shown. Such a feeder may be identical to the feeder in U.S. Pat. No. 3,915,681 hereby incorporated by reference.

Figure 1:
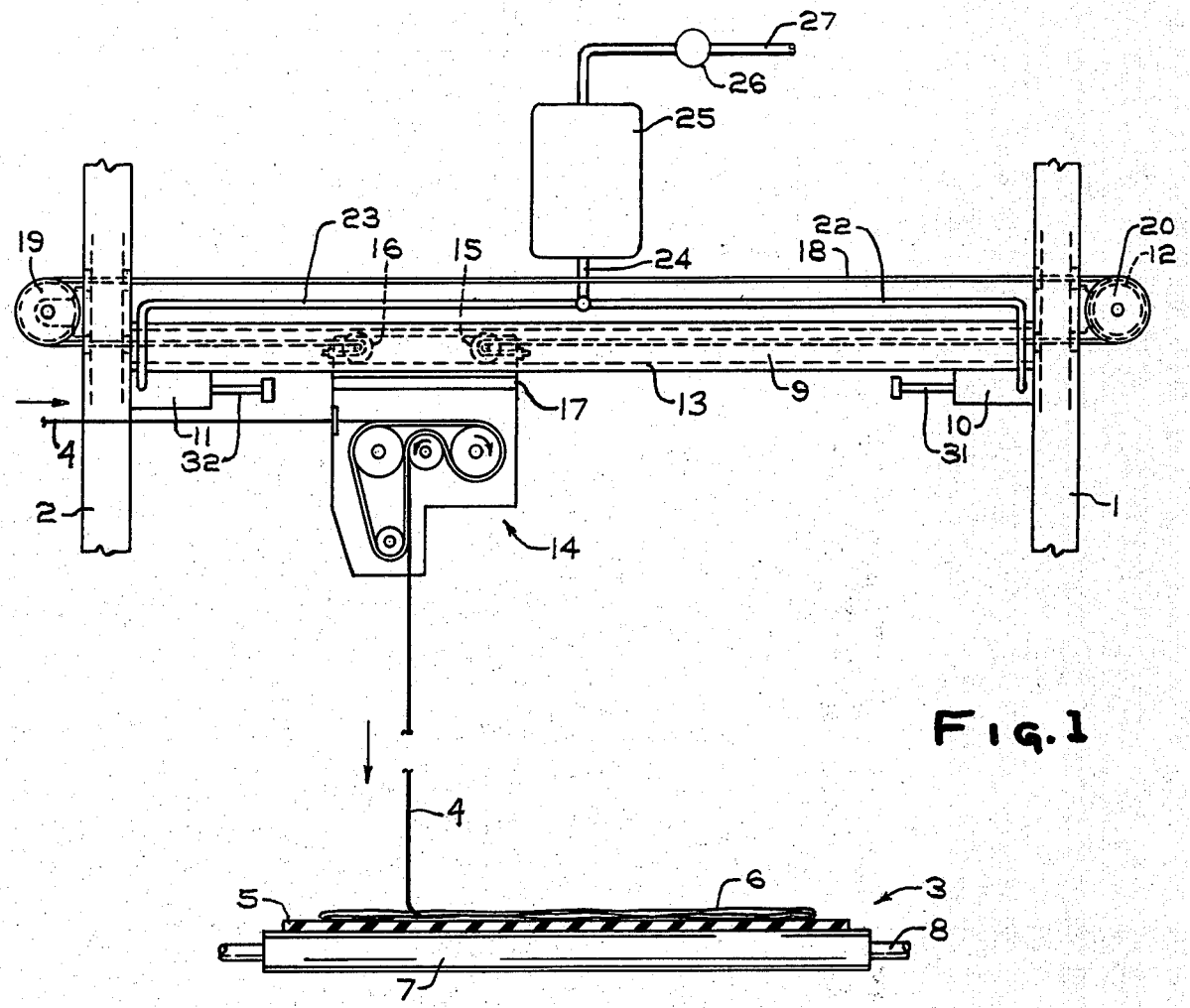
FIG. 1 is a frontal elevational view of a traversing mechanism having mounted thereon the feeding apparatus to deposit continuous glass fiber strands on an accumulating conveyor and having gas filled engaging means at each end of the traverse of the feeding apparatus and connected to a surge supply to accelerate the feeding apparatus.

Mounting members 1 and 2 support the transom 9, the gas cylinder members 10 and 11, and the drive motor 12. The transom 9 has a pair of tracks one of which is shown at 13 which support the traversing feeder 14. The traversing feeder 14 and carriage 17 are supported and guided in the tracks by two pairs of wheels, pair 15 and pair 16 which ride in the tracks. The pair of wheels 15 and 16 are mounted to the traversing carriage 17.

The traversing carriage 17 is attached to the traversing feeder 14. The traversing carriage is attached to a cable 18 which rides over pulley 19 and is also movably attached to a motor pulley 20 which is drien by motor 12 or which is adapted for reverse directional movement to a conventional motor 12. The motor can be any conventional motor like a d.c. electric motor that can be in a circuit with means for energizing and controlling the operation of the motor through a sensing means (not shown in the drawing) located at each end of the transom responsive to the location of the traversing feeder and carriage so that the motor reverses direction, when the feeder and carrige reach the end of a traversing stroke.

The gas cylinders 10 and 11 mounted on mounting numbers 1 and 2 are provided to contact the traversing feeder 14 and carriage 17 by means of the plunger arms 31 and 32. Thus, the gas cylinders with the plunger arms, which are piston rods of the piston heads inside the cylinders, absorb the shock of the traveling weight of the traversing feeder which is depositing glass fiber strand 4 on conveyor belt 5. When the traversing feeder 14 or carriage 17 contacts one or the other of plunger arms 31 or 32, the traversing feeder or carriage depresses the plunger arm into the cylinder containing gas, preferably air, at a pressure of around 18 to around 22 and preferably 20 psig, when the traversing feeder has a mass of around 35 kg. The air that is displaced as the plunger arm enters the cylinder, wherein the plunger arm has an end member at the opposite end of the end engaging the feeder, (not shown in the drawing) is moved into the gas conduit lines 22 and 23.

Gas conduit 22 is attached to the gas cylinder 10 to receive the displaced gas preferably at the opposite end of the gas cylinder from where the entering plunger arm 31 enters cylinder 10. Gas conduit 23 which is attached to gas cylinder 11 receives displaced air gas preferably at the opposite end of the cylinder 11 from where plunger arm 32 enters cylinder 11. The gas conduits 22 and 23 can have a sufficient diameter to provide the requisite volume for the displaced gas. It is preferred, when there is a plurality of traversing feeder assemblies including carriages laying glass fiber strand onto the mat, to have the gas conduits from each side of the transoms flow into one main gas surge conduit 24. The gas surge conduit is attached to a surge tank 25 to provide the requisite volume for the displaced gas from the pluraity of traversing feeder assemblies. The air supply or gas supply can enter the surge tank through a regulator and conduit 26 and 27 respectively to maintain a captive pressure within the system of surge tank, gas surge conduit, gas conduit, gas conduit lines and gas cylinders.

Once the motor reverses direction of movement of the traversing feeder assembly the plunger arm of the gas cylinder which is depressed by the feeder assembly, goes back to its extended position. This movement pushes the traversing feeder assembly away from the gas cylinder. This push is enough to overcome the inertia of the traversing feeder assembly and to accelerate the assembly to a speed of around 2 to around 3 ft/sec. At this point the motor maintains the operational speed of the assembly as it traverses to the other side of the apparatus.

Thus, the apparatus of the invention provides for the uniform disposition of glass fiber strand 4 onto a uniform mat 6 supported by belt 5, which is traveling in a direction perpendicular to the path of traverse of the traversing feeder assembly 14 and 17. The acceleration provided by the gas cylinder prevents the traversing feeder assembly from pausing at the ends of the mat as the motor reverses direction and starts the traversing feeder assembly in the opposite direction. This prevents the buildup of strand at the edges of the mat and makes the mat thickness more uniform from end to end.

Figure 2:
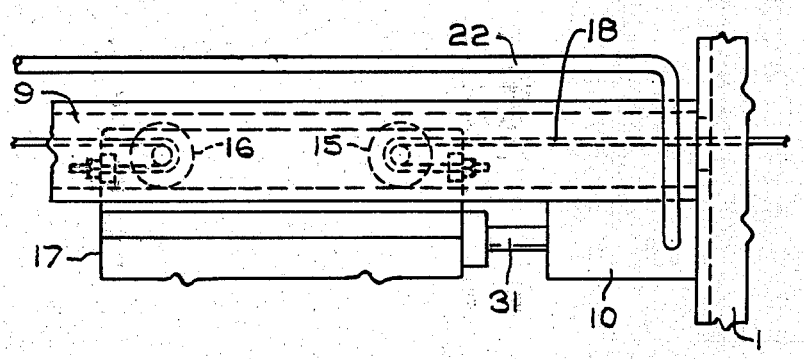
FIG. 2 is an enlarged view of the traversing mechanism of FIG. 1, where the carriage has depressed the plunger and end member of the gas cylinder.

Referring now to FIG. 2 which shows an enlarged, view of the gas cylinder and the carriage of the traversing feeder assembly associated therewith of FIG. 1, with the transom in a cut away view at a time when the plunger arm is fully depressed by the traversing feeder assembly. At this point in time the feeder assembly is about to be sent on the return stroke. The plunger arm reaches maximum depression with an end member inside cylinder 10 (not shown) having pushed the gas out the gas conduit from the force exerted against the plunger arm by the traversing feeder assembly including feeder 14 and carriage 17 being driven by motor 12 through the mechanical linkage. This force is greater than the pressure in the gas surge system and the plunger arm is depressed displacing some of the volume of gas or air in the cylinder. Suitable air cylinders for use, although larger or smaller cylinders can be used if the mass of the reciprocating device is less or more or the operating velocity of the device is less or more than the aforedescribed apparatus, are those cylinders available from Bimba Manufacturing Co., Monee, Illinois, model no. 126-D.

Figure 3:
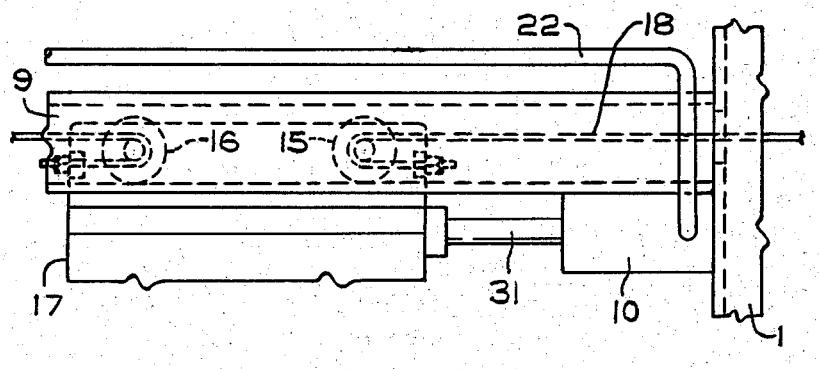
FIG. 3 is an enlarged view of the traversing mechanism of FIG. 1, while the carriage is being pushed or accelerated by the plunger extending from the gas-containing cylinder.

As the motor reverses to send the traversing feeder assembly in the opposite direction, the velocity of the traversing feeder assembly 14 and 17 approaches 0 as it depresses the plunger arm of the air cylinder. Through this deceleration there is no jerking or banging stress induced when the traversing feeder assembly is reversed. The motor which is preferably a stepper motor with cogbelt assembly (not shown in FIGS.) reverses to send the traversing feeder assembly in the opposite direction. As the force against the plunging arm is reduced and the pressure in the captive air system flows back into the cylinder and forces the plunger arm to extend, the traversing feeder assembly is pushed in the opposite direction and actually accelerates from a velocity of 0 to a velocity of around 2 ft/sec. The motor then continues to move the traversing feeder assembly in the opposite direction. This action is shown in FIG. 3, where the plunger arm 31 is extended, pushing the assembly by pushing carriage 17. The full extension of the plunger arm occurs when the end member or piston inside the cylinder contacts the inside end of the cylinder proximate to the feeder assembly. The end member can be a washer, piston or other suitable device.

The descriptions of FIGS. 1-4 elucidate the apparatus of the invention and the explanation of the operation of this apparatus is descriptive of a traversing mechanism having a particular utility in the area of traversing of glass fiber strands across a conveyor to form a substantially uniform continuous glass fiber strand mat. The traversing mechanism has minimal maintenance due to its smooth mechanic operation in the reduction of jerking and mechanical stress on the various parts of the traversing apparatus and the mechanism can utilize a motor having a lower horsepower and torque requirements to traverse a conveyor, since the motor need not overcome inertia of the feeder traversing assembly when it reverses direction.

Although the invention has been described with reference to specific apparatus and component parts, the invention is not to be limited only in respect thereto, but only limited insofar as set forth in the accompanying claims.

We claim:

1. In an apparatus for reciprocating a movable glass fiber feeding device traversing along an axis having means for supporting and guiding said device along said axis; and means for providing the traversing motion to said device along said axis in a single horizontal plane, the improvement comprising:

(a) a pair of engageable means each having a movable extending member and where each is affixed to an end of said axis so that the movable extended member engages said movable device and is compressed when the movable device approaches the end of the axis, and (b) a gas supply source connected to the engageable means to extend the engageable means engaging the movable device to apply acceleration force to said device to initiate reciprocating motion to the device to traverse along said axis in the opposite direction.

2. The apparatus of claim 1 wherein the gas is air.

3. The apparatus of claim 1 wherein the engageable means is comprised of a plunger arm for the movable member which is movably connected with a cylinder having said gas.

4. The apparatus of claim 3 wherein the plunger arm of the engageable means in a fully extended condition is positioned along said axis first to engage said movable device to apply a decelerating force by depressing into the cylinder and second to apply an acceleration force by extending to its original position by gaseous pressure to push the movable device to which the engageable means is engaged.

5. The apparatus of claim 1 wherein the accelerating force is sufficient to move the reciprocating movable device having a mass of around 35 kg. from a velocity of 0 to a velocity of around 2 to around 3 ft/sec.

6. An apparatus for reciprocating a movable glass fiber feeder for continuous glass fiber strand along an axis, comprising:

(a) means for supporting and guiding said glass fiber feeder along said axis;

(b) drive means for providing motion to said glass fiber feeder to move along said axis in a reciprocating traversing motion, (c) a pair of engageable means attached one at each end of said axis for applying accelerating and decelerating forces to said movable glass fiber feeder at the termination of each reciprocation stroke of said device, wherein each engageable means has a movable member and gas cylinder where the movable member extends from and is movably connected to the gas cylinder which is affixed at the termination of the reciprocating stroke of the movable glass fiber feeder so that the extending member engages the reciprocating movable glass fiber feeder as the feeder is moving in a direction toward the extended movable member and from such engagement the movable member is compressed into the gas cylinder to decelerate the movable glass fiber feeder and so that while engaging the movable device the compressed movable member can apply an acceleration force to the movable glass fiber feeder to move the device in an opposite direction when pressurized gas in the cylinder is increased, and (d) container means of pressurized gas connected to the cylinder of the engaging means to supply pressurized gas to extend the movable member of the engaging means to accelerate said glass fiber feeder in the opposite direction to the direction at which said glass fiber feeder first engages the engageable means.

7. Apparatus of claim 6 wherein said movable glass fiber feeder is a glass fiber attenuator.

8. Apparatus according to claim 6 wherein said supporting and guiding means is a transom defined by said axis and wheels mounted on said movable glass fiber feeder said wheels riding on said transom.

9. Apparatus of claim 6 wherein the pressurized gas is air.

10. Apparatus of claim 6, wherein the pair of engageable means for applying decelerative and accelerative forces comprises: one air cylinder placed at each end of the termination of each reciprocating stroke wherein the air cylinders have plungers extending from the cylinders that are attached to a pressurized air source so that an extended plunger of one air cylinder engages the movable glass fiber feeder at the termination of each reciprocation stroke and is depressed to provide said decelerative force to the movable glass fiber feeder and so that the depressed plunger is activated to extend by the pressurized air to provide the acceleration force to the movable glass fiber feeder in a direction opposite to that direction at termination.

11. Apparatus of claim 10 wherein the cylinder connected to the container means of pressurized air has an aperture to lock air out of the cylinder when the plunger is depressed.

12. Apparatus of claim 10 wherein the container means is an air surge system to accept the volume of displaced air from the cylinder when the plunger is depressed and to provide the pressurized air to the cylinder to extend the plunger once the drive means reverses direction.

13. Apparatus of claim 12, wherein the air pressure of the surge system is around 18 to around 25 psign for a reciprocating glass fiber feeder having a mass of around 35 kg to be accelerated to a velocity of around 2 to around 3 feet per second.

14. Apparatus of claim 12 wherein the axis has a sensing means just before the termination of each stroke by the reciprocating glass fiber feeder connected in a circuit to the driving means to signal the driving means to reverse directions when the reciprocating device is sensed by the sensing means.

15. Apparatus of claim 12 wherein the reciprocating glass fiber feeder traverses across a moving conveyor.

16. A plurality of apparatus of claim 6 wherein each pair of engageable means is connected through the cylinder portions of the engageable means to a container means of pressurized gas so that the container means can absorb the volumes of pressurized gas displaced from each cylinder when the extending arm of the engageable means is depressed and so that the container means can supply pressurized gas to each engageable means with a depressed extendable arm engaging a movable glass fiber feeder when the drive means is able to drive the movable glass fiber feeder in the opposite direction.

17. Plurality of apparatus of claim 15 wherein the container means is a pressurized surge system connected to each cylinder by conduits.

* * * * *

UNITED STATES PATENT AND TRADEMARK OFFICE

CERTIFICATE OF CORRECTION

PATENT NO. : 4,340,406

DATED : July 20, 1982

INVENTOR(S) : Jeffrey A. Neubauer and Walter J. Reese

It is certified that error appears in the above-identified patent and that said Letters Patent are hereby corrected as shown below:

Claim 13, column 8, line 48 in the patent should read

—Apparatus of Claim 12 or Claim 17, wherein—.

Claim 13, column 8, line 49, "psign" should read -- psig --

Signed and Sealed this

*Twenty-sixth* Day of *October 1982*

[SEAL]

*Attest:*

GERALD J. MOSSINGHOFF

*Attesting Officer*

*Commissioner of Patents and Trademarks*